US005611302A

United States Patent [19]

Duvinage et al.

[11] Patent Number: 5,611,302

[45] Date of Patent: Mar. 18, 1997

[54] TWO CYCLE INTERNAL COMBUSTION ENGINE WITH UNIDIRECTIONAL FLOW SCAVENGING

[75] Inventors: Frank Duvinage, Kirchheim; Markus Paule, Korb, both of Germany

[73] Assignee: Daimler-Benz AG, Stuttgart, Germany

[21] Appl. No.: 669,233

[22] Filed: Jun. 24, 1996

[30] Foreign Application Priority Data

Jun. 30, 1995 [DE] Germany ..... 195 23 928.8

[51] Int. Cl.[6] ..... F01M 1/00

[52] U.S. Cl. ..... 123/65 VC; 123/65 P; 123/196 M

[58] Field of Search ..... 123/65 VC, 65 P, 123/65 A, 196 M

[56] References Cited

U.S. PATENT DOCUMENTS

| | | | |
|---|---|---|---|
| 1,092,042 | 3/1914 | Hagar | 123/65 VC |
| 1,812,379 | 6/1931 | Spencer | 123/65 A |
| 1,967,682 | 7/1934 | Ochtman | 123/65 A |
| 2,043,296 | 6/1936 | Luchsinger et al. | 123/65 V |
| 2,242,231 | 5/1941 | Cantoni | 123/65 VC |
| 2,627,255 | 2/1953 | Kiekhaefer | 123/65 A |
| 2,735,260 | 2/1956 | Laubender | 123/65 A |
| 4,280,455 | 7/1981 | Yamaguchi et al. | 123/196 M |

FOREIGN PATENT DOCUMENTS

| | | | |
|---|---|---|---|
| 145724 | 5/1936 | Hungary | 123/65 VC |
| 4-132834 | 5/1992 | Japan | 123/65 P |
| 616893 | 7/1952 | United Kingdom | 123/65 VC |

*Primary Examiner*—David A. Okonsky
*Attorney, Agent, or Firm*—Klaus J. Bach

[57] ABSTRACT

In a two cycle internal combustion engine with uni-directional flow scavenging wherein a piston is disposed in a cylinder so as to be movable between top and bottom dead center end positions, the cylinder has fresh air inlet passages which are so arranged that their bottom walls are disposed below the piston top edge when the piston is in its bottom dead center position so that part of the piston top land is directly exposed to the fresh air flow through the air inlet passages and oil discharge bores extend from the air inlet passages and are in communication with the oil circulating system for the removal of oil wiped off the cylinder wall and collected in the inlet passages.

5 Claims, 1 Drawing Sheet

TWO CYCLE INTERNAL COMBUSTION ENGINE WITH UNIDIRECTIONAL FLOW SCAVENGING

BACKGROUND OF THE INVENTION

The invention relates to a two cycle internal combustion engine with uni-directional flow scavenging of a cylinder wherin the cylinder wall includes, in the area of the lower dead center location of the piston, inlet passages for the introduction of fresh gas into the combustion chamber defined by the cylinder wall and which is provided with an oil circuit for the lubrication of the piston in the cylinder.

Such a two cycle engine is known for example from U.S. Pat. No. 2,043,296.

However, the two cycle engine design described in this patent has the disadvantage that the piston top land, that is, the piston portion between the uppermost annular groove and the piston top becomes very hot during the operation of the two cycle engine so that the piston top land is subjected high strain and that, furthermore, the emissions of the two cycle engine are relatively high particularly because lubricating oil which is utilized for the lubrication of the piston within the cylinder enters the combustion chamber of the two cycle engine and is combusted therein.

It is the object of the present invention to provide a two cycle internal combustion engine with uni-directional flow scavenging without the disadvantages inherent in the arrangements of the prior art, particularly, an engine wherein the strain to which the piston top land is exposed is relatively small and also the emissions are low.

SUMMARY OF THE INVENTION

In a two cycle internal combustion engine with uni-directional flow scavenging wherein a piston is disposed in a cylinder so as to be movable between top and bottom dead center positions, the cylinder has fresh air inlet passages which are so arranged that their bottom walls are disposed below the piston top edge when the piston is in its bottom dead center position so that part of the piston top land is directly exposed to the fresh air flow through the air inlet passages, and wherein oil discharge bores extend from the air inlet passages and are in communication with the oil circulating system for the removal of oil wiped off the cylinder wall and collected in the inlet passages.

Since, with this arrangement, the upper edge of the piston is, in the lower dead center position of the piston, above the lower edges of the inlet passages for the fresh scavenging gas, the piston top land can be cooled directly by the inflowing fresh gas. This makes it possible to provide a top land of only relatively small height and pistons with only relatively small installation tolerances. The mechanical and thermal stability of the two cycle engine can be improved in this manner.

Furthermore, the arrangement according to the invention permits lubricating oil displaced by the piston rings during downward movement of the piston toward its lower dead center position to be discharged into the passages from where it is removed through the oil discharge passages so that the lubricating oil collected in the fresh air scavenging passages is not entrained into the fresh air scavenging flow during the air inlet cycle and carried into the engine cylinder and combusted during the subsequent engine combustion stroke. Consequently, the emissions which result from lubricating oil entrainment and the subsequent combustion thereof in the engine cylinder is eliminated so that the over-all engine emissions are reduced.

The invention will become more readily apparent from the following description of preferred embodiments thereof described on the basis of the attached schematic drawings.

DESCRIPTION OF A PREFERRED EMBODIMENT

Figure 1:
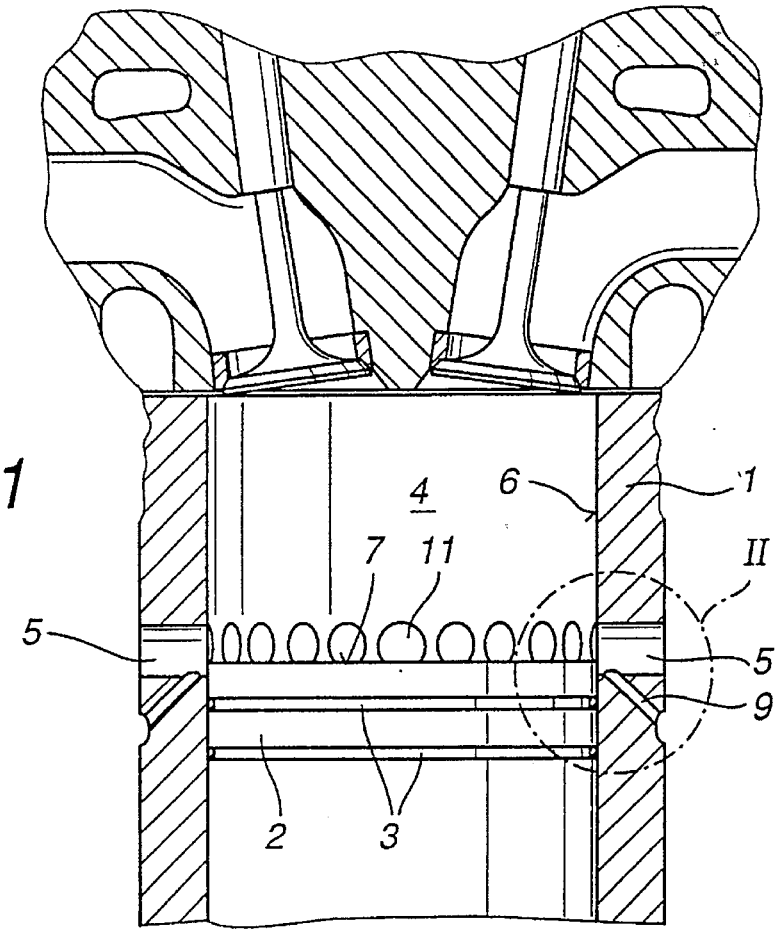
FIG. 1 is a cross-sectional view of a cylinder of a two-cycle internal combustion engine according to the invention.

FIG. 1 shows, in a cross sectional view, a cylinder 1 of a two cycle internal combustion engine with uni-directional flow scavenging.

The cylinder 1 receives a piston 2 which is guided therein in well known manner, the piston 2 having piston rings 3 disposed in piston grooves.

Above the piston 2 (which may be provided with a combustion cavity), there is a combustion chamber 4 to which fresh gas (air) is admitted during operation of the two-cycle engine through inlet passages 5 extending through the wall of the cylinder 1.

In order to minimize friction between the piston 2 and the wall of the cylinder 1, an oil film is applied to the inner wall of the cylinder 1 which may be formed by a sleeve 6 mounted on the cylinder wall. The oil film is applied by suitable means which are well known in the art and which are therefore not shown.

Figure 2:
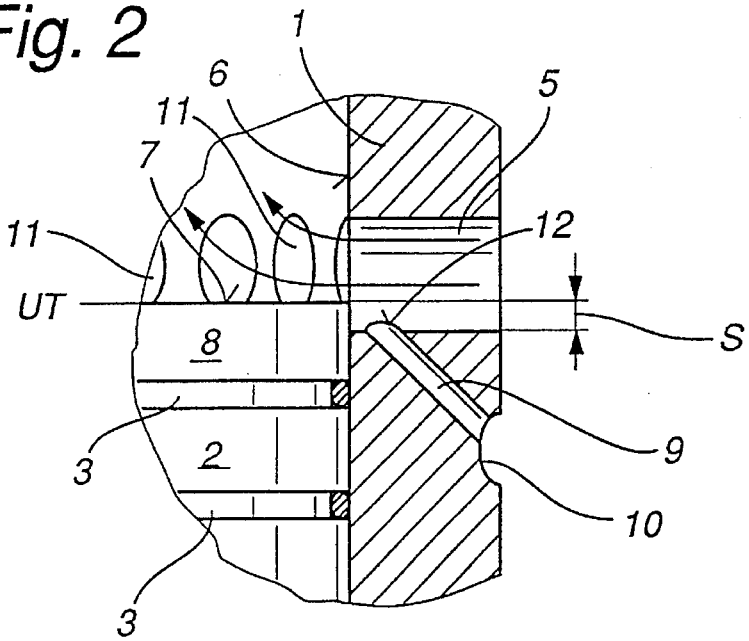
FIG. 2 is an enlarged representation of the area encircled by the dash-dotted line II of FIG. 1.

FIG. 2 is an enlarged view of the area encircled in FIG. 1 by a dash-dotted line II. As represented in FIGS. 1 and 2, the piston 2 is in its bottom dead center position.

The gas inlet passages 5 with the inlet openings 11 which may be in the form of slots or which may be circular as shown in the drawings, are so arranged that, in the bottom dead center position of the piston 2, the upper circumferential edge 7 of the piston 2, that is the top of the piston, is disposed at a higher level than the bottom edge of the inlet channels 5 so that, in the bottom dead center position of the piston 2, there is a predetermined distance "S" between the circumferential edge 7 of the piston and the lower surface of the inlet passage 5 where the top portion of the piston is exposed.

The fresh gas entering the combustion chamber 4 (see FIG. 1) through the inlet channels 5 is consequently in direct contact with a good part of the circumferential edge of the piston 2 whereby this part of the piston, that is, the piston top land 8 is cooled directly by the inflowing fresh gas.

Consequently, the piston top land is subjected to only relatively low temperatures during operation of the two cycle engine.

As a result, a piston top land of relatively small height can be provided and, at the same time, the piston clearance can be smaller than it is in present engines of this type.

Furthermore, oil wiped by the piston rings off the cylinder sleeve 6 during the engine power stroke, that is during downward movement of the piston, is collected in the inlet passages 5 and is retained therein adjacent the top circumferential edge 7 of the piston 2 which exceeds the bottom surface of the inlet passages by the height S.

This oil is removed through oil discharge bores 9 with oil collecting openings 12 at the end of the inlet passages 5 adjacent the combustion chamber 4 where the oil wiped off the cylinder wall is collected. The oil is removed from the inlet passages for example by suction so that the oil cannot be re-entrained into the combustion chamber during the filling cycle of the two cycle engine (see arrows in FIG. 2) where it would be combusted during the engine combustion cycle and lead to increased emission of noxious gases.

Of course, the oil may be removed from the inlet passages 5 not only in a continuous manner but it may also be sucked out in a pulsed manner depending on the piston location or in any other suitable manner.

The openings of the oil discharge bores 9 remote from the inlet passage 5 lead to an annular groove 10 extending around the cylinder 1 wherein the oil is collected and is subsequently returned, by way of a suitable pipe system, to the oil circulating system of the two-cycle engine.

It should be apparent that, in place of the annular groove 10, other collection means such as oil collection pockets may be provided in which the oil passing through the oil discharge bores 9 can be collected.

With the arrangement described herein wherein the piston 2 extends in its bottom dead center position slightly above the bottom walls of the inlet passages 5, the thermal strain of the piston top land 8 and the noxious gas emission of a two cycle internal combustion engine can be substantially reduced.

What is claimed is:

1. A two cycle internal combustion engine with unidirectional flow scavenging, comprising: a piston disposed in a cylinder so as to be movable therein between a top dead center position and a bottom dead center position and defining, in said cylinder above said piston, a combustion chamber, said piston having a top edge and, adjacent thereto, a top land, and said cylinder having inlet passages for supplying fresh gas to said combustion chamber and an oil circulating system for the lubrication of the piston to facilitate movement thereof in said cylinder between said top and bottom dead center positions, said inlet passages having bottom walls and being so arranged that said bottom walls are disposed below the piston top edge when said piston is in its bottom dead center position so that part of the piston top land is directly exposed to the fresh air entering said combustion chamber through said inlet passages, and oil discharge passages extending through said cylinder wall and having at one end an oil collection opening in said inlet passage and being, at the opposite end, in communication with the oil circulating system for the removal of oil wiped off the cylinder wall and collected in said inlet passages.

2. An internal combustion engine according to claim 1, wherein said oil discharge passages are so arranged that their oil collection openings are disposed in the bottom wall of said inlet passages and at their end adjacent said combustion chamber.

3. An internal combustion engine according to claim 1, wherein said oil discharge passages extend from said inlet passages to an annular groove formed in the wall of said cylinder.

4. An internal combustion engine according to claim 1, wherein said oil discharge passages extend from said inlet passages to oil collection pockets.

5. An internal combustion engine according to claim 3, wherein said oil discharge passages are bores extending through said cylinder wall.

* * * * *